United States Patent [19]

Iwanaga et al.

[11] Patent Number: 5,049,204

[45] Date of Patent: Sep. 17, 1991

[54] PROCESS FOR PRODUCING A GRAIN-ORIENTED ELECTRICAL STEEL SHEET BY MEANS OF RAPID QUENCH-SOLIDIFICATION PROCESS

[75] Inventors: Isao Iwanaga; Kenzo Iwayama; Kenichi Miyazawa; Toshiaki Mizoguchi, all of Kitakyusyushi, Japan

[73] Assignee: Nippon Steel Corporation, Tokyo, Japan

[21] Appl. No.: 501,133

[22] Filed: Mar. 29, 1990

[30] Foreign Application Priority Data

Mar. 30, 1989 [JP] Japan ..... 1-79984
Mar. 30, 1989 [JP] Japan ..... 1-79985
Mar. 30, 1989 [JP] Japan ..... 1-79986

[51] Int. Cl.[5] ..... H01F 1/04

[52] U.S. Cl. ..... 148/111; 164/463; 164/476; 164/477

[58] Field of Search ..... 148/111; 164/463, 476, 164/477

[56] References Cited

U.S. PATENT DOCUMENTS 4,715,905 12/1987 Nakaoka et al. ..... 148/111
4,851,052 7/1989 Nishioka et al. ..... 148/2

FOREIGN PATENT DOCUMENTS 59-126717 7/1984 Japan ..... 148/112
61-79723 4/1986 Japan ..... 148/111
63-295044 12/1988 Japan ..... 164/476

*Primary Examiner*—John P. Sheenan
*Attorney, Agent, or Firm*—Wenderoth, Lind & Ponack

[57] ABSTRACT

The present invention concerns a process for producing a grain-oriented electrical steel sheet by means of a rapid quench-solidification process, for example, a continuous casting by a twin roll strip caster. The feature of the present invention resides in quenching to solidify molten steels into a thin cast sheet of 0.7 to 3.0 mm thickness, at a cooling rate of greater than 50° C./sec. in the central portion along the direction of thickness of the thin cast sheet, cooling the sheet at a cooling rate of greater than 10° C./sec. in a temperature range between 1300° to 900° C. and then applying cold rolling for once or twice or more annealing the thin cast steel for a period between 30 seconds and 30 minutes in a temperature range between 950° and 1,200° C. and subsequently including intermediate annealing under a final cold rolling reduction rate of not less than 80%. In the present invention, precipitates that function as an inhibitor can finely be dispersed by adding 0.02 to 0.2% of Nb into the molten steel ingredients thereby to stably produce a grain-oriented electrical steel sheet of high magnetic flux density by means of a rapid quench-solidification process. Further, since a thin cast sheet of desired thickness within a range from 0.7 to 3.0 mm can be produced by the rapid quench-solidification process, the thin cast sheet can be cold rolled to a final thickness of less than 150 μm by applying a cold rolling at a reduction rate optimum to magnetic properties, and an extremely thin grain-oriented electrical steel sheet of less than 150 μm (0.15 mm) thickness can be produced in a simple production process and at a reduced cost, which so far has been remarkably difficult and expensive to produce.

7 Claims, 2 Drawing Sheets

{200} Pole Figure

{200} Pole Figure

PROCESS FOR PRODUCING A GRAIN-ORIENTED ELECTRICAL STEEL SHEET BY MEANS OF RAPID QUENCH-SOLIDIFICATION PROCESS

TECHNICAL FIELD

The present invention concerns a process for producing a grain-oriented electrical steel sheet having high magnetic flux density using, as starting material, a thin cast sheet containing from 2.5 to 4.5% by weight of Si obtained by a rapid quench-solidification process.

BACKGROUND ART

Grain-oriented electrical steel sheets are used as core material in electrical equipments such as transformers and large-sized rotational machines. It is required for the grain-oriented electrical steel sheets having such application uses that they have magnetic characteristics of satisfactory exciting property and low core loss. Among all, core material of low core loss has been required in view of energy saving in recent years.

In the conventional process for producing grain-oriented electrical steel sheets, ingots or slabs obtained by continuous casting have been used as starting material. For obtaining products having excellent magnetic properties from such starting material, there has been employed a process of heating the starting material at high temperature thereby completely solidifying inhibitors such as AlN or MnS, and then finely precipitating them. Accordingly, the hot rolling is an essential step.

On the other hand, in a process of obtaining a thin cast sheet by a rapid quench-solidification process as in a sheet casting process, for example, by using twin rolls, a thin cast sheet is cooled after solidification at a cooling rate of greater than 0.05° C./sec. at least to 600° C., thereby refining the crystal grains, and the thin cast sheet is re-heated in the subsequent step, thereby finely dispersing precipitate as disclosed in Japanese Patent Laid-Open Publication Sho 53-97923 and 54-83620. However, these publications show nothing about the crystallographical texture of the thin cast sheet and an appropriate reduction rate during cold rolling after the casting, which are important factors for the secondary recrystallization of material.

Further, a process for producing grain-oriented electrical steel sheets is also disclosed in Japanese Patent Laid-Open Publication Sho 63-11619 and 63-176427, in which molten metal containing 2.5 to 6.5% by weight of Si is continuously supplied on a cooling body having a cooling surface that is moved and refreshed, for example, a twin roll caster, and solidified by quenching into a thin sheet of 0.7 to 3.5 mm thickness. Then, the thin cast sheet is cold rolled under a reduction rate of not less than 50% and then annealed.

In the prior art described above, the rapid quench-solidification is applied for making the crystal grains finer and the cold rolling under a reduction rate of not less than 50% is applied for finely dispersing precipitate along with the annealing applied subsequently, but they do not at all show that these measures are taken for the crystallographical texture of the thin cast sheet which is an important factor for the secondary recrystallization of material;

Further, Japanese Patent Laid-Open Publication Sho 56-158816 discloses a process for producing grain-oriented electrical steel sheets, including steps of continuously casting molten metal containing less than 4.5% by weight of Si into a thin cast sheet of 3 to 80 mm thickness, and then applying hot rolling under a reduction rate of not less than 50% in a temperature range not lower than 700° C. to obtain a hot-rolled steel sheet of 1.5 to 3.5 mm thickness. In this publication, it is described that no satisfactory secondary recrystallization is formed if the thin cast sheet is not hot rolled due to insufficiency of Goss nuclei and, accordingly, products with satisfactory magnetic properties cannot be obtained.

In the process for producing grain-oriented electrical steel sheets by the rapid quench-solidification process utilizing the inhibitor as described above, it is not clear that this is for the crystallographical texture of the thin cast sheet and appropriate reduction rate in the cold rolling for developing the secondary recrystallization also in a case of saving the hot rolling step, required for obtaining products having satisfactory magnetic properties.

Further, although it has been well-known to reduce the thickness of the products as a means for lowering the core loss in the grain-oriented electrical steel sheets, it has been difficult from an industrial point of view. That is, in a case of reducing the plate thickness by chemical polishing, production yield is remarkably lowered. Further, if the plate thickness is reduced by rolling, there has been a problem that the formation of the secondary recrystallization is difficult.

Japanese Patent Laid-Open Publications Sho 59-126722 and 61-79721 disclose a method of applying two stage cold rolling after hot rolling in order to stably form secondary recrystallization in the grain-oriented electrical steel sheets of a reduced plate thickness. However, the prior art involves a problem that the production cost is increased since two stage cold rolling is necessary. Further, Japanese Patent Laid-Open Publications Sho 61-217526 and 61-238916 disclose a method of applying CBS (contact-bend-stretch) rolling to the hot-rolled material, so that the rolled crystallographical texture is improved and the secondary recrystallization can stably be formed even if the plate thickness is less than 0.18 mm. However, since the prior arts require a special rolling machine, there has also been a problem that the production cost is increased. Further, Japanese Patent Laid-Open Publication Sho 61-238939 discloses a method of forming a thin cast sheet from molten metal by way of a rapid quench-solidification process and then applying cold rolling at least for once under a reduction rate of 55 to 80% as a means capable of stably forming secondary recrystallization even in a case where the plate thickness is less than 0.15 mm. However, in the case of the prior art, there has been a problem that it is difficult to obtain products of high magnetic flux density due to the low reduction ratio in the final cold rolling.

DISCLOSURE OF THE INVENTION

An object of the present invention is to provide a process capable of producing grain-oriented electrical steel sheets of excellent magnetic properties having extremely high orientation in the cold rolling direction with {110}<001> texture in a process for producing grain-oriented electrical steel sheets by means of a rapid quench-solidification process requiring neither re-heating of a slab nor hot rolling, by properly combining the secondary cooling conditions and the direction of crystallization in thin cast sheets in a rapid quench-solidification process (continuous casting process) and conditions for cold rolling.

Another object of the present invention is to provide a production process capable of producing an extremely thin grain-oriented electrical steel sheet with a thickness of less than 0.15 mm at a reduced cost, which has been extremely difficult to produce and required expensive cost as described above.

A further object of the present invention is to provide a process capable of producing grain-oriented electrical steel sheets of excellent magnetic properties by strengthening the inhibitor in a process for producing grain-oriented electrical steel sheets by means of a rapid quench-solidification process (continuous casting process).

For overcoming the foregoing technical subjects in the present invention, the present inventors have made a further study and, as a result, found that it is necessary to make the secondary cooling rate after rapid quench-solidification sufficiently higher in order to finely disperse and precipitate AlN, MnS, etc. in steels so that they can function as an inhibitor, and also that a cast texture comprising {110}<0vw> columnar texture is formed with no substantial Goss nuclei if the secondary cooling rate is excessively high and, accordingly, it is necessary to apply cold rolling including intermediate annealing at a final cold rolling reduction rate of not less than 80% for forming satisfactory secondary recrystallization.

On the other hand, the present inventors have also found that a cast texture with random crystallographical orientation is formed if the secondary cooling rate for the thin cast sheet after solidification is appropriate, and a secondary recrystallization texture with extremely high Goss orientation {110}<001> can be obtained by the cold rolling for once under a reduction rate of not less than 80%, although less Goss nuclei are present as compared with those in the conventional production process requiring hot rolling as the essential step. On the basis of these findings the inventors accomplished the present invention.

That is, the feature of the present invention resides in quenching to solidify molten steels comprising 2.5 to 4.5% by weight of Si, an inhibitor forming element known per se, other ingredient elements necessary for electrical steel, and the balance of Fe and inevitable impurities, at a cooling rate in the central portion along the thickness of the cast sheets greater than 50° C./sec. by means of a cooling body having a moving and refreshing cooling surface to form a thin cast sheet of 0.7 to 3.0 mm thickness, cooling the thin cast sheet at a cooling rate of not less than 10° C./sec. between 1300 to 900° C., and then applying cold rolling for once or twice or more including an intermediate annealing and then applying a final cold rolling at a reduction rate of not less than 80%. Further, the present invention includes an embodiment in which molten steels formed into a thin cast sheet by means of the rapid quench-solidification have a composition of 0.03 to 0.10% C, 2.5 to 4.5% Si, 0.02 to 0.15% Mn, 0.01 to 0.05% S, 0.01 to 0.04% acid soluble Al, 0.003 to 0.015% N on a weight basis, and the balance consisting of Fe and inevitable impurities. The present invention also includes an embodiment in which molten steels formed into a thin cast sheet by means of the rapid quench-solidification have a composition of 0.3 to 0.10% C, 2.5 to 4.5% Si, 0.20 to 0.15% Mn, at least one of such elements as 0.01 to 0.15% Sb, 0.01 to 0.05% S and 0.01 to 0.05% Se on the weight basis, and the balance consisting of Fe and inevitable impurities. Further, the present invention also includes an embodiment of applying cold rolling for once or twice or more including an intermediate annealing with a final cold reduction rate of not less than 80% to a thin cast sheet, into a final plate thickness of 150 μm. Further, the present invention includes an embodiment in which molten steels formed into a thin cast sheet by means of the rapid quench-solidification have a composition of 0.03 to 0.10% C, 2.5 to 4.5% Si, 0.02 to 0.15% Mn, 0.01 to 0.05% S, 0.01 to 0.04% acid soluble Al, 0.003 to 0.015% N, 0.02 to 0.2% Nb on a weight basis, and the balance consisting of Fe and inevitable impurities.

DESCRIPTION OF THE ACCOMPANYING DRAWINGS

FIGS. 1(*a*), (*b*) are {200} pole figure illustrating the texture of a thin cast sheet;

BEST MODE FOR PRACTICING THE INVENTION

Figure 1A:
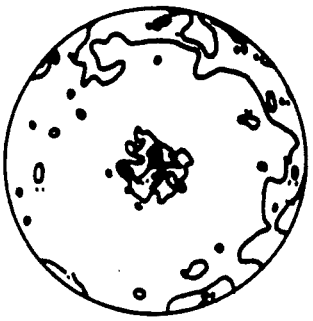
Figure 1B:
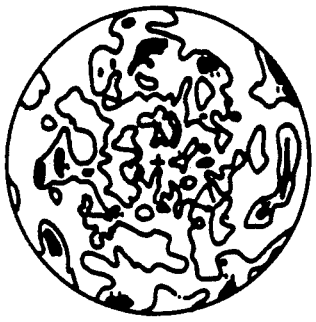
Figure 2:
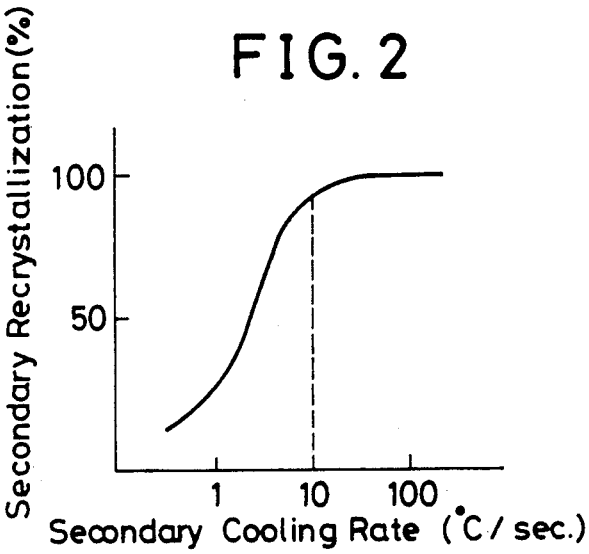
FIG. 2 is a graph illustrating a relationship between the secondary cooling rate and secondary recrystallization.

In a process for producing grain-oriented electrical steel sheets, without a hot rolling step, by means of a rapid quench-solidification process utilizing inhibitors, the method of obtaining thin cast sheets by the rapid quench-solidification process can include, mainly, a twin roll method and a single roll method. In a case of obtaining thin cast sheets of 0.7 to 3.0 mm thickness by these methods, since the temperature of the thin cast sheet just after leaving the roll surface is higher than 1400° C., if secondary cooling of applying water spray to the thin cast sheet is not conducted, the size of precipitate is made coarser, making it difficult to function as an inhibitor, as well as being unable to obtain satisfactory secondary recrystallization since the thin cast sheet is recrystallized and made coarser, tending to form an uneven crystal texture after cold rolling and annealing. Accordingly, for obtaining products having satisfactory magnetic properties, the thin cast sheet has to be quenched after solidification at a cooling rate of not less than 10° C./sec. at least in a temperature region between 1300° to 900° C. (see FIG. 2). Further, if sufficient secondary cooling is conducted by applying water spray to the thin cast sheet, since a cast texture having {100}<0vw> columnar textures as shown in FIG. 1(*a*) is formed, Goss nuclei are reduced substantially to zero and, accordingly, no secondary recrystallization occurs by the one stage cold rolling method. However, if cold rolling for twice or more including an intermediate annealing is applied under a reduction rate of not less than 80% in the final cold rolling to the thin cast sheet, a satisfactory secondary recrystallization texture can be obtained.

Figure 3:
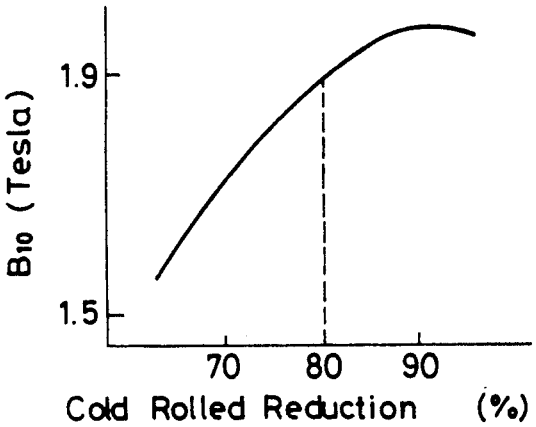
FIG. 3 is a graph illustrating a relationship between the cold rolled reduction and magnetic properties $B_{10}$.

On the other hand, if the starting temperature for the secondary cooling is lowered, recrystallization occurs after solidification to form a random cast texture as shown in FIG. 1(*b*). In this case, since Goss nuclei are present, although not so much as in the material by way of the conventional hot rolling step, a satisfactory secondary recrystallization texture with extremely high Goss orientation can be obtained by the one stage cold rolling under a reduction rate of not less than 80% (see FIG. 3).

In this way, by changing the step conditions after casting depending on the cast texture, the grain-oriented electrical steel sheets can be produced in any of the cases, but a process for producing by one stage cold rolling under a reduction rate of not less than 80% is preferred since the number of steps can be decreased and the cost is reduced.

The reason for defining the composition of the steels and the production conditions as described above will now be explained. At first, description will be made for the definition of the ingredient system.

The lower limit for the content of C is defined as 0.03% for the sake of forming a $\gamma$ phase which is good for getting a good primaries. On the other hand, the upper limit for the content is defined as 0.10% so as to avoid a difficulty in decarburization.

The lower limit for the content of Si is defined as 2.5% so as to lower the core loss in the products. If it exceeds 4.5%, cracks are liable to form in the material upon cold rolling, making the cold forming difficult.

The ingredients described below are elements for forming a precipitation-dispersion phase that functions as an inhibitor upon secondary recrystallization. That is, Mn: 0.02 to 0.15%, S: 0.01 to 0.05%, acid soluble Al: 0.01 to 0.04%, N: 0.003 to 0.15%, Sb: 0.01 to 0.15% and Se: 0.01 to 0.05% can function as the inhibitor by properly combining two or more of them and incorporating them into steels. In addition, at least one of Cu and Sn can be added within a range of less than 1.0% for strengthening the inhibitor.

Then, in the present invention, a thin cast sheet of 0.7 to 3.0 mm thickness is obtained from molten steels by means of a rapid quench-solidification process. For obtaining a satisfactory secondary recrystallization texture on the basis of the rapid quench-solidification process, if the thickness of the thin cast sheets is less than 0.7 mm, the reduction rate in cold rolling can not be increased as required in the present invention. On the other hand, if the thickness of the thin cast sheet exceeds 3.0 mm, the reduction rate in the cold rolling becomes excessive, failing to obtain sharp Goss nuclei, and the rigidity of the thin cast sheet is increased making it difficult for threading.

Referring to the secondary cooling for the thin cast sheet after rapid quench-solidification, although rapid quenching sufficient to suppress the formation of coarse precipitate is preferred, it is enough to apply cooling at a cooling rate higher than 10° C./sec. in a temperature range between 1300° to 900° C. in order for the precipitate to act as an inhibitor and to obtain a random texture for ensuring Goss nuclei.

The cooling rate upon solidification is greater than 50° C./sec. in a case where the thickness of the thin cast sheet is 0.7 to 3.0 mm.

The resultant thin cast sheet is formed into a final plate thickness by means of one stage cold rolling in a case where the cast texture has a random orientation, or by means of two stage cold rolling including an intermediate annealing in a temperature range from 800° to 1100° C. under the final cold reduction rate of not less than 80% in a case where the cast texture comprises {100}<0vw> columnar texture. Then, the cold rolled steel sheet was applied with decarburization annealing in a moist hydrogen atmosphere, then coated with an annealing separation agent comprising MgO as the main ingredient, and then applied with finishing annealing in a temperature range higher than 1100° C. for secondary recrystallization and purification of steels. Thus, grain-oriented electrical steel sheets are produced by the rapid quench-solidification process.

Now, description will be made of a process for producing extremely thin grain-oriented electrical steel sheets with the final plate thickness of less than 150 $\mu$m by the above-mentioned production process based on the rapid quench-solidification process.

In a case of producing extremely thin grain-oriented electrical steel sheets by the conventional production process of applying hot rolling by heating an electrical steel slab, there has been a limit for reducing the plate thickness of the hot rolled plate since there is a problem of requiring a large power rolling machine and a problem of reduction in the plate temperature that degrades the inhibitor due to excess precipitation. In this prior art, for obtaining products with a final plate thickness of not greater than 150 $\mu$m by applying usual cold rolling to the material, a two stage cold rolling method has to be employed so that the reduction rate is not so high.

By the way, in the conventional production process of heating and hot rolling the electrical steel slabs, if the final cold rolling reduction rate is increased to greater than 90%, sharp Goss nuclei are reduced to remarkably lower the magnetic flux density in the products.

In the rapid quench-solidification process, the thickness of the cold rolled material can be decreased easily. Accordingly, in the rapid quench-solidification process, it is possible to produce extremely thin grain-oriented electrical steel sheets with less than 150 $\mu$m thickness by a one stage cold rolling, which has been impossible in the conventional production process. The present inventors have found that extremely thin grain-oriented electrical steel sheets having extremely high magnetic flux density can be produced in the rapid quench-solidification process by setting the final cold rolling reduction rate greater than 80%, preferably, greater than 90%. It is considered that since the thin cast sheet obtained by the rapid quench-solidification process contains less Goss nuclei as compared with the conventional production process of heating and hot rolling the electrical steel slabs, an appropriate range for the reduction rate is present on the side of a higher reduction rate for obtaining sharp Goss.

The thin cast sheet obtained by the rapid quench-solidification process is annealed in a temperature range from 950° to 1200° C. for 30 sec. to 30 min. Then, the thin cast sheet is rolled for obtaining a steel sheet with a final plate thickness of not greater than 150 $\mu$m by one or two or more stage cold reduction with intermediate annealing under a final cold rolling reduction rate of greater than 80%. Then, the steel sheet is annealed for decarburization in a moist hydrogen atmosphere, further coated with an annealing separation agent comprising MgO as a main ingredient and applied with finishing annealing in a temperature range of higher than 1100° C. for the secondary recrystallization and the purification of steels. Thus, extremely thin grain-oriented electrical steel sheets can be produced by the rapid quench-solidification process.

Description will now be made to a means for further strengthening the inhibitor in a process for producing grain-oriented electrical steel sheets by means of a rapid quench-solidification process.

In the thin cast sheet obtained by the rapid quench-solidification process, since introduction of relocations due to work strains is extremely less and the size of crystal grains is greater as compared with the material obtained by the conventional process of heating and hot rolling electrical steel slabs, the precipitation site for the inhibitor is remarkably reduced and coarse precipitates of 0.1 to 1.0 μm are liable to be formed making it difficult to attain the function of the inhibitor. With such a condition of the precipitate, since the inhibitor is weak and the secondary recrystallization becomes unstable as compared with that in the material obtained by the conventional process, high reduction rate can not be taken in the cold rolling and, accordingly, it is difficult to obtain products of high magnetic flux density.

Figure 4:
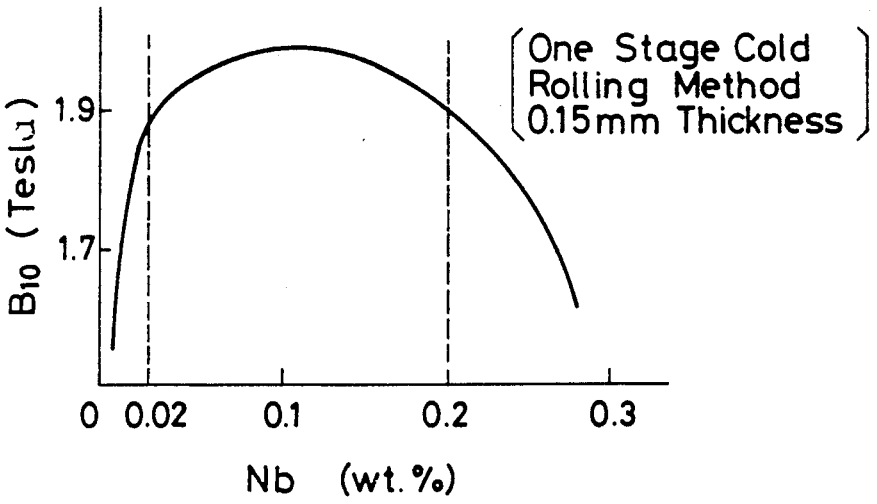
FIG. 4 is a graph illustrating a relationship between the addition amount of Nb in molten steel and the magnetic properties $B_{10}$.

The present inventors have made studies on a means for strengthening the inhibitor upon producing grain-oriented electrical steel sheets by the rapid quench-solidification process and, as a result, have found that the inhibitor is strengthened and a stable secondary recrystallization forming region is extended as far as a high reduction rate by incorporating 0.02 to 0.20% of Nb into molten steels comprising usual ingredients of the grain-oriented electrical steels. As shown in FIG. 4, it is possible to produce products having a stable high magnetic flux density by the addition of Nb. The effect of strengthening the inhibitor by the addition of Nb is made greater in thinner products of unstable secondary recrystallization.

It is considered that secondary recrystallization develops stably by incorporating from 0.02 to 0.20% of Nb, because addition of Nb, which is a powerful carbide- and nitride-forming element, can promote precipitation and nucleation and finely disperse the precipitates while suppressing their growth, thereby strengthening the function of the inhibitor.

In the production process for grain-oriented electrical steel sheets by the rapid quench-solidification process with addition of Nb, the starting material is a thin cast sheet obtained by continuous rapid quench-solidification, for example, by means of a twin roll strip caster, of molten steels comprising C: 0.03 to 0.10%, Si: 2.5 to 4.5%, Mn: 0.02 to 0.15%, S: 0.01 to 0.05%, acid soluble Al: 0.01 to 0.04%, N: 0.003 to 0.015%, Nb: 0.02 to 0.20% on a weight basis, and the balance consisting of Fe and inevitable impurities.

The thin cast sheet is annealed in a temperature range from 950° to 1200° C. for 30 sec. to 30 min. and then cold rolled for once or twice or more including intermediate annealing at a final cold rolling reduction rate of not less than 80%.

Then, the cold rolled steel sheet is annealed for decarburization in a moist hydrogen atmosphere, coated with an annealing separation agent mainly composed of MgO and then further applied with finishing annealing in a temperature range higher than 1100° C. for the secondary recrystallization and the purification of steels. Thus, grain-oriented electrical steel sheets of high magnetic flux density can be produced by the rapid quench-solidification process.

EXAMPLE 1

Molten steels of compositions of steel ingredients shown in Table 1 were formed into thin cast sheets of 2.3 mm thickness by using twin rolls and applied with weak water cooling and strong water cooling by adjusting the starting time for the air cooling and water spray for the secondary cooling conditions just after the casting. Then, they were annealed at 1050° C. for 5 min, pickled and then cold rolled at a reduction rate of 87% into 0.30 mm thickness. Besides, identical materials cold rolled after pickling into 1.2 mm thickness were applied with intermediate annealing at 1050° C. for 5 min. and, further cold rolled at a reduction rate of 75% into 0.30 mm thickness. Then, the finally cold rolled materials of 0.30 mm thickness were annealed for decarburization in a moist hydrogen atmosphere, coated with a MgO powder and then annealed at a high temperature in a hydrogen gas atmosphere at 1200° C. for 10 hours. The magnetic properties of the resultant products are as shown in Table 2, in which the properties comparable with those of the products obtained by the one stage cold rolling process and the two stage cold rolling process of conventional grain-oriented high magnetic flux density electrical steel sheets could be obtained by one or two stage cold rolling in the case of the weak water cooling and by two stage cold rolling in the case of the strong water cooling for the secondary cooling. Further, as shown in FIG. 1, the crystallographical orientation near the surface of the thin cast sheet material was random in the case of weak water cooling (b) and mainly at {100}<0vw> with the Goss ingredient being substantially zero in the case of strong water cooling (a) for the secondary cooling.

TABLE 1

| Type of steel | Ingredient composition (wt %) | | | | | | | Secondary cooling condition |
|---|---|---|---|---|---|---|---|---|
| | C | Si | Mn | P | S | sol. Al | N | |
| A | 0.056 | 3.10 | 0.078 | 0.009 | 0.026 | 0.024 | 0.0072 | Air cooling |
| B | 0.058 | 3.07 | 0.079 | 0.007 | 0.025 | 0.027 | 0.0075 | Weak water cooling |
| C | 0.059 | 3.06 | 0.075 | 0.009 | 0.025 | 0.028 | 0.0077 | Strong water cooling |

TABLE 2

| Type of steel | Cold rolling | Magnetic flux density $B_{10}$ (T) | Evaluation |
|---|---|---|---|
| A | one stage | 1.54 | X |
| A | two stage | 1.59 | X |
| B | one stage | 1.92 | ○ |
| B | two stage | 1.89 | ○ |
| C | one stage | 1.63 | X |
| C | two stage | 1.88 | ○ |

X: Poor; ○: Good

EXAMPLE 2

Molten steels of compositions for steel ingredients shown in Table 3 were formed into thin cast sheets of 4.0 to 0.9 mm thickness by using twin rolls and then applied with identical weak water cooling as in Example 1 for the secondary cooling just after the casting. Then, they were annealed at 1050° C. for 5 min., further pickled and then cold rolled at a reduction rate of 92 to 67%, into 0.30 mm thickness. The finally cold rolled materials of 0.30 mm thickness were annealed for decarburization in a moist hydrogen atmosphere, coated with a MgO powder and then annealed at high temperature in a hydrogen gas atmosphere at 1200° C. for 10 hours. The magnetic properties of the resultant products are as shown in Table 4, in which magnetic properties comparable with those of conventional grain-oriented high magnetic flux density electrical steel sheets preferably produced by a one stage cold rolling process could be obtained, when the cold rolling reduction rate was not less than 80%.

TABLE 3

| Type of steel | Ingredient compositions (wt %) | | | | | | | Thickness of cast sheet (mm) |
|---|---|---|---|---|---|---|---|---|
| | C | Si | Mn | P | S | sol. Al | N | |
| D | 0.058 | 3.12 | 0.078 | 0.008 | 0.026 | 0.023 | 0.0080 | 4.0 |
| E | 0.053 | 3.09 | 0.076 | 0.007 | 0.026 | 0.028 | 0.0077 | 3.0 |
| F | 0.057 | 3.06 | 0.078 | 0.007 | 0.024 | 0.025 | 0.0082 | 2.2 |
| G | 0.056 | 3.10 | 0.075 | 0.009 | 0.026 | 0.024 | 0.0075 | 1.3 |
| H | 0.054 | 3.09 | 0.077 | 0.007 | 0.024 | 0.024 | 0.0076 | 0.9 |

TABLE 4

| Type of steel | Cold rolled reduction | Magnetic flux density $B_{10}$ (T) | Evaluation |
|---|---|---|---|
| D | 92% | 1.94 | ○ |
| E | 90 | 1.93 | ○ |
| F | 86 | 1.91 | ○ |
| G | 77 | 1.86 | X |
| H | 67 | 1.67 | X |

EXAMPLE 3

Molten steels of compositions for steel ingredients shown in Table 5 were formed into thin steel sheets of 2.4 mm thickness by using twin rolls and applied with strong water cooling as in Example 1 for secondary cooling just after the casting. Then, they were annealed at 1000° C. for 5 min., further pickled and then cold rolled into 0.8 mm thickness, which were applied with intermediate annealing at 950° C. for 5 min. and further cold rolled at a reduction rate of 62% into 0.30 mm thickness. The finally cold rolled materials of 0.30 mm thickness were annealed for decarburization in a moist hydrogen atmosphere, and coated with a MgO powder. Then, after keeping only the steel J at 900° C. for 30 hours, while not so keeping the other steels, all of the steel samples were annealed at a high temperature in a hydrogen gas atmosphere at 1200° C. for 10 hours. As shown in Table 6, the magnetic properties of the resultant products were comparable with those of the grain-oriented high magnetic flux density electrical steel sheets obtained by the conventional two stage cold rolling process, for all of the ingredient compositions.

TABLE 5

| Type of steel | Ingredient compositions (wt %) | | | | | | | | | Thickness of cast sheet (mm) |
|---|---|---|---|---|---|---|---|---|---|---|
| | C | Si | Mn | P | S | sol. Al | N | Se | Sb | |
| I | 0.049 | 3.16 | 0.056 | 0.003 | 0.024 | 0.0015 | 0.0036 | — | — | 2.4 |
| J | 0.043 | 3.11 | 0.059 | 0.006 | 0.002 | 0.0016 | 0.0012 | 0.020 | 0.024 | 2.4 |

TABLE 6

| Type of steel | Cold rolled reduction | Magnetic flux density $B_{10}$ (T) | Evaluation |
|---|---|---|---|
| I | 62% | 1.86 | ○ |
| J | 60 | 1.88 | ○ |

EXAMPLE 4

A molten steel containing ingredients shown in Table 7 was formed into thin cast sheets of 3.0 and 1.2 mm thickness by using twin rolls. On the other hand, a continuous cast slab comprising the same ingredients was hot rolled and formed into a hot rolled sheet of 1.2 mm thickness as the comparative material. Then, after applying preliminary cold rolling only to the thin cast sheet of 3 0 mm thickness into a plate thickness of 0.5 mm, all of the materials were annealed at 1100° C. for, 5 min., pickled and, further, cold rolled into 0.05 mm plate thickness.

Then, they were annealed for decarburization in a moist hydrogen atmosphere, coated with a MgO powder and then annealed at a high temperature in a hydrogen gas atmosphere at 1200° C. for 10 hours.

As shown in Table 8, extremely thin products obtained by the process according to the present invention show extremely excellent magnetic properties.

TABLE 7

| Type of steel | Ingredient compositions (wt %) | | | | | | | | |
|---|---|---|---|---|---|---|---|---|---|
| | C | Si | Mn | P | S | sol. Al | N | Cu | Sn |
| K | 0.055 | 3.20 | 0.075 | 0.012 | 0.025 | 0.026 | 0.0078 | 0.15 | 0.08 |

TABLE 8

| Material | Magnetic properties | |
|---|---|---|
| | $B_{10}$ (T) | $W_{17/50}$ (w/Kg) |
| Thin cast sheet | | |
| 3.0 mm (with preliminary cold rolling) | 1.91 | 0.74 |
| 1.2 mm | 1.93 | 0.71 |
| Hot rolled sheet 1.2 mm | 1.56 | — |

EXAMPLE 5

A molten steel containing the ingredients shown in Table 9 was formed into cast sheets of 2.4 and 1.5 mm thickness by using twin rolls and, as a comparative material, a continuous cast slab of the same ingredients was hot rolled and formed into a hot rolled sheet of 2.4 mm thickness. Then, only the thin cast sheet of 2.4 mm thickness and the hot rolled sheet of 2.4 mm thickness were applied with intermediate cold rolling into a plate thickness of 0.7 mm, then, all of the sheets were annealed at 1070° C. for 5 min., further pickled and then cold rolled into 0.10 mm thickness.

Then, they were annealed for decarburization in a moist hydrogen atmosphere, coated with a MgO powder and then annealed at high temperature in a hydrogen gas atmosphere at 1200° C. for 10 hours.

As shown in Table 10, extremely thin products obtained by the process according to the present invention show extremely excellent magnetic properties.

TABLE 9

| Type of steel | Ingredient compositions (wt %) | | | | | | |
|---|---|---|---|---|---|---|---|
| | C | Si | Mn | P | S | Sb | Se |
| L | 0.051 | 3.05 | 0.080 | 0.008 | 0.022 | 0.054 | 0.019 |

TABLE 10

| Material | Magnetic properties | |
|---|---|---|
| | $B_{10}$ (T) | $W_{17/50}$ (w/Kg) |
| Thin cast sheet | | |
| 2.4 mm (with intermediate cold rolling) | 1.89 | 0.81 |
| 1.5 mm | 1.91 | 0.76 |
| Hot rolled sheet 2.4 mm (with intermediate cold rolling) | 1.72 | — |

EXAMPLE 6

Molten steels of compositions for steel ingredients shown in Table 11 were formed into thin cast sheets of 2.0 mm thickness by using twin rolls.

Then, they were annealed at 1050° C. for 5 min., pickled and then cold rolled into 0.15 mm thickness. Further, identical material cold rolled into 1.2 mm thickness after pickling was applied with intermediate annealing at 1050° C. for 5 min., and, further cold rolled into 0.15 mm thickness. Then, they were annealed for decarburization in a moist hydrogen atmosphere, coated with a MgO powder and then annealed at high temperature in a hydrogen gas atmosphere at 1200° C. for 10 hours. As shown in Table 12 for the magnetic properties of the resultant products, Nb-added materials in accordance with the present invention can provide satisfactory magnetic properties in both cases of one and two stage cold rolling.

TABLE 11

| Type of steel | Ingredient compositions (wt %) | | | | | | | | | |
|---|---|---|---|---|---|---|---|---|---|---|
| | C | Si | Mn | P | S | sol. Al | N | Cu | Sn | Nb |
| M | 0.052 | 3.18 | 0.071 | 0.012 | 0.024 | 0.027 | 0.0078 | 0.11 | 0.08 | <0.001 |
| N | 0.055 | 3.15 | 0.076 | 0.009 | 0.024 | 0.025 | 0.0077 | — | — | 0.045 |
| O | 0.050 | 3.20 | 0.078 | 0.007 | 0.026 | 0.028 | 0.0074 | 0.12 | 0.09 | 0.100 |

TABLE 12

| Type of steel | Cold rolling | Magnetic flux density $B_{10}$ (T) | Remarks |
|---|---|---|---|
| M | one stage | 1.58 | Conventional method |
| | two stage | 1.87 | Conventional method |
| N | one stage | 1.94 | Invented method |
| | two stage | 1.92 | Invented method |
| O | one stage | 1.93 | Invented method |

TABLE 12-continued

| Type of steel | Cold rolling | Magnetic flux density $B_{10}$ (T) | Remarks |
|---|---|---|---|
| | two stage | 1.90 | Invented method |

What is claimed is:

1. A process for producing a grain-oriented electrical steel sheet by means of a rapid quench-solidification process, which comprises quenching to solidify molten steels into a thin cast sheet of 0.7 to 3.0 mm thickness, at a cooling rate of greater than 50° C./sec. in the central portion along the direction of the thickness of said thin cast sheet, said steels comprising 2.5 to 4.5% by weight of Si and an inhibitor-forming element known per se, other elements necessary for electrical steels, and the balance consisting essentially of Fe and inevitable impurities, cooling said thin cast sheet at a cooling rate of greater than 10° C./sec. in a temperature range between 1300° to 900° C., annealing said thin cast sheet for a period between 30 seconds and 30 minutes in a temperature range between 950° to 1,200° C., applying cold rolling for once or twice or more including intermediate annealing under a final cold rolling reduction rate of not less than 80%, thereby imparting a final gage thereto, and then applying annealing for decarburization, coating of a separation agent and then finishing annealing.

2. A process as defined in claim 1, wherein the molten steels comprise C: 0.03 to 0.10%, Si: 2.5 to 4.5%, Mn: 0.02 to 0.15%, S: 0.01 to 0.05%, acid soluble Al: 0.01 to 0.04%, N: 0.003 to 0.015% on a weight basis, and the balance consisting essentially of Fe and inevitable impurities.

3. A process as defined in claim 1 and wherein the molten steels comprise C: 0.03 to 0.10%, Si: 2.5 to 4.5%, Mn: 0.02 to 0.15%, at least one of Sb: 0.01 to 0.15%, S: 0.01 to 0.05%, and Se: 0.01 to 0.05%, on a weight basis, and the balance consisting essentially of Fe and inevitable impurities.

4. A process as defined in claim 1, wherein the molten steels comprise C: 0.03 to 0.10%, Si: 2.5 to 4.5%, Mn: 0.02 to 0.15%, S: 0.01 to 0.05%, acid soluble Al: 0.01 to 0.04%, N: 0.003 to 0.015%, Nb: 0.02 to 0.2% on a weight basis, and the balance consisting essentially of Fe and inevitable impurities.

5. A process as defined in any one of claims 1 to 4, wherein the molten steels contain at least one of Cu, Sn and Sb each in an amount less than 1.0%.

6. A process as defined in any one of claims 1 to 4 wherein cold rolling for once or twice or more including intermediate annealing under a final cold rolling reduction rate of not less than 80% is applied for forming the thin cast sheet into a final thickness of less than 150 μm.

7. A process as defined in claim 5, wherein cold rolling for once or twice or more including intermediate annealing under a final cold rolling reduction rate of not less than 80% is applied for forming the thin cast sheet into a final thickness of less than 150μm.

* * * * *